US010836160B2

(12) United States Patent
Mizuno

(10) Patent No.: US 10,836,160 B2
(45) Date of Patent: Nov. 17, 2020

(54) LIQUID EJECTING DEVICE INCLUDING TEMPERATURE SENSOR FOR DETECTING TEMPERATURE OF LIQUID TO BE SUPPLIED TO NOZZLES

(71) Applicant: BROTHER KOGYO KABUSHIKI KAISHA, Nagoya-shi (JP)

(72) Inventor: Taisuke Mizuno, Yokkaichi (JP)

(73) Assignee: BROTHER KOGYO KABUSHIKI KAISHA, Nagoya-shi (JP)

( * ) Notice: Subject to any disclaimer, the term of this patent is extended or adjusted under 35 U.S.C. 154(b) by 0 days.

(21) Appl. No.: 15/988,699

(22) Filed: May 24, 2018

(65) Prior Publication Data

US 2019/0092003 A1 Mar. 28, 2019

(30) Foreign Application Priority Data

Sep. 26, 2017 (JP) ..... 2017-184828

(51) Int. Cl.
*B41J 2/045* (2006.01)
*B41J 2/14* (2006.01)
*B41J 2/155* (2006.01)

(52) U.S. Cl.
CPC ..... *B41J 2/04563* (2013.01); *B41J 2/04581* (2013.01); *B41J 2/1433* (2013.01); *B41J 2/14201* (2013.01); *B41J 2/14233* (2013.01); *B41J 2/155* (2013.01); *B41J 2002/14241* (2013.01); *B41J 2002/14419* (2013.01); *B41J 2002/14459* (2013.01); *B41J 2002/14491* (2013.01); *B41J 2202/11* (2013.01); *B41J 2202/12* (2013.01)

(58) Field of Classification Search
CPC ..... B41J 2/04563; B41J 2/04581; B41J 2/04588; B41J 29/38; B41J 2/14233; B41J 2002/14419; B41J 2/14201; B41J 2/1433
USPC ..... 347/9, 10, 12, 17, 19
See application file for complete search history.

(56) References Cited

U.S. PATENT DOCUMENTS

2010/0309244 A1 12/2010 Yamada
2013/0194335 A1* 8/2013 Nodsu ..... B41J 29/38 347/14
2016/0347055 A1* 12/2016 Yamaguchi ..... B41J 2/04563

FOREIGN PATENT DOCUMENTS

JP 2010-284824 A 12/2010
JP 2015-101034 A 6/2015

* cited by examiner

*Primary Examiner* — Jannelle M Lebron
(74) *Attorney, Agent, or Firm* — Merchant & Gould P.C.

(57) ABSTRACT

A liquid cartridge includes: a plurality of nozzles; a plurality of pressure chambers each in communication with each nozzle; a plurality of piezoelectric elements; a plurality of manifolds; a supply passage; a connection passage; and a temperature sensor. Each piezoelectric element is configured to apply pressure to liquid stored in each pressure chamber. The manifolds are in communication with the pressure chambers. The connection passage connects the supply passage to each of the manifolds and is configured to distribute the liquid supplied from the supply passage into the plurality of manifolds. The temperature sensor is provided at the connection passage and is configured to detect a temperature of the liquid flowing through the connection passage.

14 Claims, 8 Drawing Sheets

LIQUID EJECTING DEVICE INCLUDING TEMPERATURE SENSOR FOR DETECTING TEMPERATURE OF LIQUID TO BE SUPPLIED TO NOZZLES

CROSS REFERENCE TO RELATED APPLICATION

This application claims priority from Japanese Patent Application No. 2017-184828 filed Sep. 26, 2017. The entire content of the priority application is incorporated herein by reference.

TECHNICAL FIELD

The present disclosure relates to a liquid ejecting device.

BACKGROUND

There is conventionally known a liquid ejecting device in which piezoelectric elements are configured to apply pressure to corresponding pressure chambers to eject ink from corresponding nozzles each in communication with each pressure chamber. Amount of ink ejected from each nozzle may be changed due to change in viscosity of the ink, the viscosity being dependent on a temperature of the ink. Therefore, adjustment in driving voltage applied to the piezoelectric elements is required in accordance with the temperature of the ink.

Japanese Patent Application Publication No. 2010-284824 discloses a liquid ejecting device provided with a temperature sensor. According to the disclosed device, an ink-supply source is connected to an ink-supply port of a recording head through an ink-supply passage, and the ink-supply port is in communication with a plurality of channels through a single outward passage. The channels are in communication with nozzles for ejecting ink that are provided in regions at which piezoelectric elements are formed. Further, a temperature sensor is provided at the ink-supply port to detect temperature of the ink flowing therethrough.

Further, the channels are in communication with a plurality of return passages which are connected to a discharge port through a connection passage. A temperature sensor is also provided at the discharge port to detect temperature of the ink flowing therethrough. Thus, temperature of the ink is estimated on a basis of temperatures detected by the temperature sensors at the ink-supply port and the ink discharge port.

SUMMARY

In such conventional liquid ejecting device, temperature control to the ink and ejection control to the ink can be facilitated the more the temperature sensor approaches the nozzles because the temperature of the ink ejected from the nozzles can be detected more accurately at the closer position. However, electrical wiring becomes complicated if the temperature sensor is provided downstream of a manifold such as an outward passage, i.e., if the temperature sensor is positioned closer to the nozzles than to the manifold.

On the other hand, according to the conventional liquid ejecting device, the temperature sensor is provided at the ink-supply port. If a plurality of outward passages is provided, a connection passage for connecting the ink-supply port to the plurality of outward passages is required, similar to the connection passage connected to the plurality of return passages. Therefore, the temperature sensor is positioned remote from the nozzles, which degrades detection of ink temperature.

In view of the foregoing, it is an object of the present disclosure to provide a liquid ejecting device capable of accurately performing temperature detection at a lower cost.

In order to attain the above and other objects, the present disclosure provides a liquid ejecting device including a plurality of nozzles, a plurality of pressure chambers, a plurality of piezoelectric elements, a plurality of manifolds, a supply passage, a connection passage, and a temperature sensor. Each of the plurality of pressure chambers is in communication with each of the plurality of nozzles. Each of the plurality of piezoelectric elements is configured to apply pressure to liquid stored in each of the plurality of pressure chambers. The plurality of manifolds is in communication with the plurality of pressure chambers. The supply passage is configured to supply the liquid to the plurality of manifolds. The connection passage connects the supply passage to each of the plurality of manifolds. The connection passage is configured to distribute the liquid supplied from the supply passage into the plurality of manifolds. The temperature sensor is provided at the connection passage and is configured to detect a temperature of the liquid flowing through the connection passage.

DETAILED DESCRIPTION

Hereinafter, one embodiment of the present disclosure will be described while referring to accompanying drawings.

Embodiment

A liquid ejecting device 10 according to the embodiment will be described with reference to FIGS. 1 through 6.

<Overall Structure of Liquid Ejecting Device>

Figure 1:
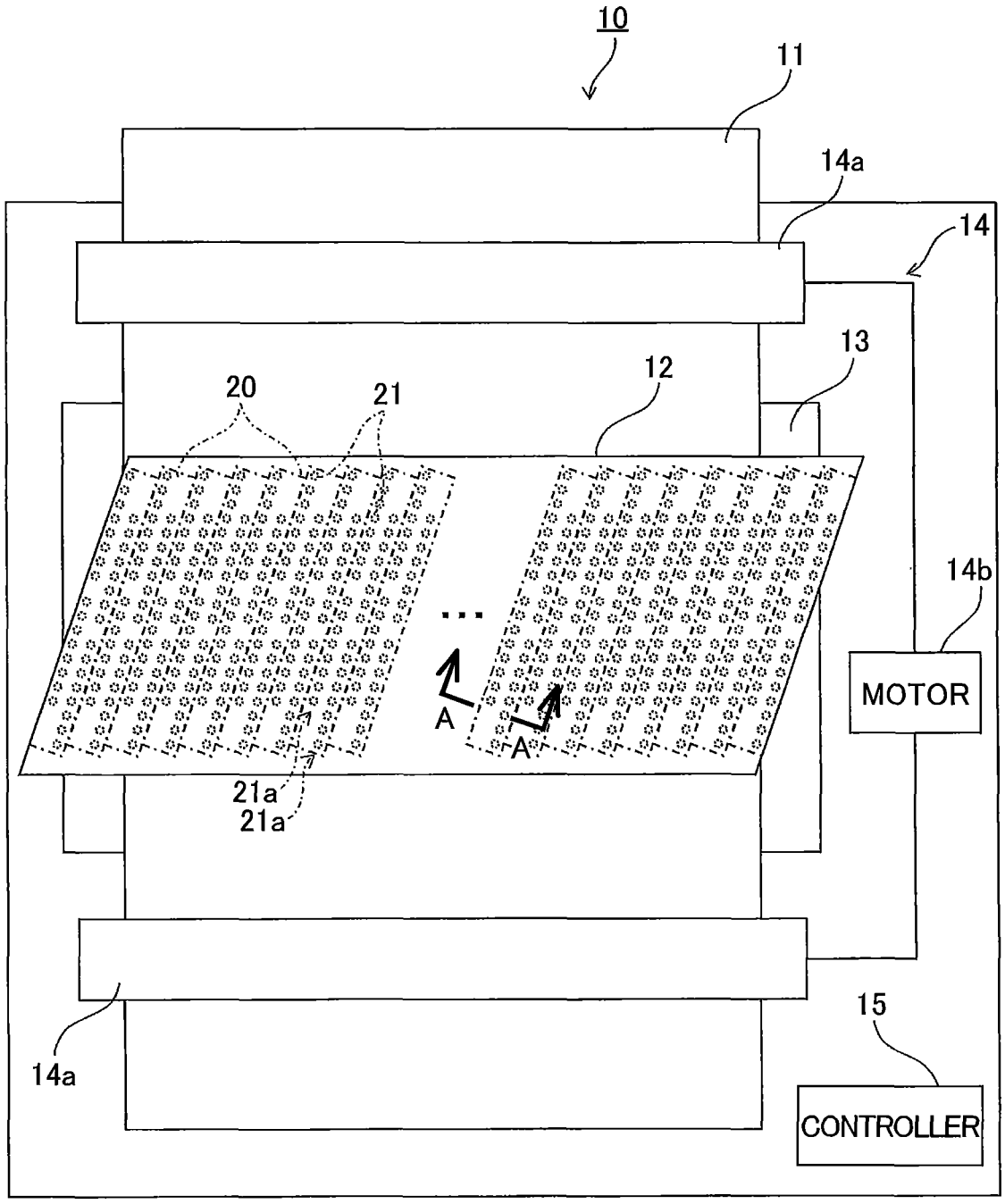
FIG. 1 is a schematic view illustrating a liquid ejecting device according to one embodiment.
Figure 1:
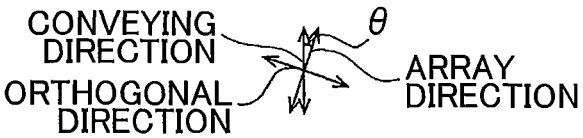

As illustrated in FIG. 1, the liquid ejecting device 10 according to the embodiment is a printer configured to print images with liquid such as an ink on recording medium 11 such as sheets of paper. The liquid ejecting device 10 includes a head unit 12, a platen 13, a conveying mechanism 14, and a controller 15. The liquid ejecting device 10 is a line printer in which a position of the head unit 12 is fixed. However, the liquid ejecting device 10 may be other type of liquid ejecting device in which a head unit is movable in a direction perpendicular to a conveying direction of the recording medium 11.

The head unit 12 includes a plurality of heads 20 arrayed with each other in a direction perpendicular to the conveying direction. Each head 20 includes a plurality of nozzles 21 through which the liquid is configured to be ejected. Details of the heads 20 will be described later.

The platen 13 is a support on which the recording medium 11 is mounted. The platen 13 is positioned to face a nozzle surface of the head 20 at which each nozzle 21 is open. The conveying mechanism 14 is configured to convey the recording medium 11. The conveying mechanism 14 includes two pairs of rollers 14*a*, and a conveyer motor 14*b* for driving the two pairs of rollers 14*a*. The two pairs of rollers 14*a* are arranged to oppose each other in the conveying direction with the platen 13 interposed between the two pairs of rollers 14*a*. That is, the platen 13 is positioned between the two pairs of rollers 14*a* in the conveying direction. Each pair of rollers 14*a* is arranged to nip the recording medium 11 therebetween. The two rollers 14*a* in each pair are configured to rotate in opposite directions from each other, when driven by the conveyer motor 14*b*, so as to convey the recording medium 11 in the conveying direction.

The controller 15 includes a computing device (not illustrated) and a storage device (not illustrated). The computing device is mainly constituted by a processor. The storage device is constituted by a memory to which the computing device can access. The storage device stores program for controlling operations of the liquid ejecting device 10. Specifically, each component in the liquid ejecting device 10 is configured to be controlled when the program stored in the storage device is executed by the computing device.

<Head>

As illustrated in FIG. 1, the plurality of nozzles 21 in each head 20 is linearly arrayed in a direction crossing the conveying direction by a predetermined angle θ (hereinafter, referred to as "array direction") to constitute a pair of nozzle arrays 21*a*. That is, each head 20 includes two nozzle arrays 21*a* extending in the array direction. The two nozzle arrays 21*a* are spaced away from each other in a direction orthogonal to the array direction (hereinafter, referred to as "orthogonal direction"). Each nozzle array 21*a* includes the same number of nozzles 21. Note that, the angle θ formed between the array direction and the conveying direction (i.e., the angle formed by each nozzle array 21*a* with respect to the conveying direction) may range from 30 degrees to 60 degrees, for example.

Figure 2:
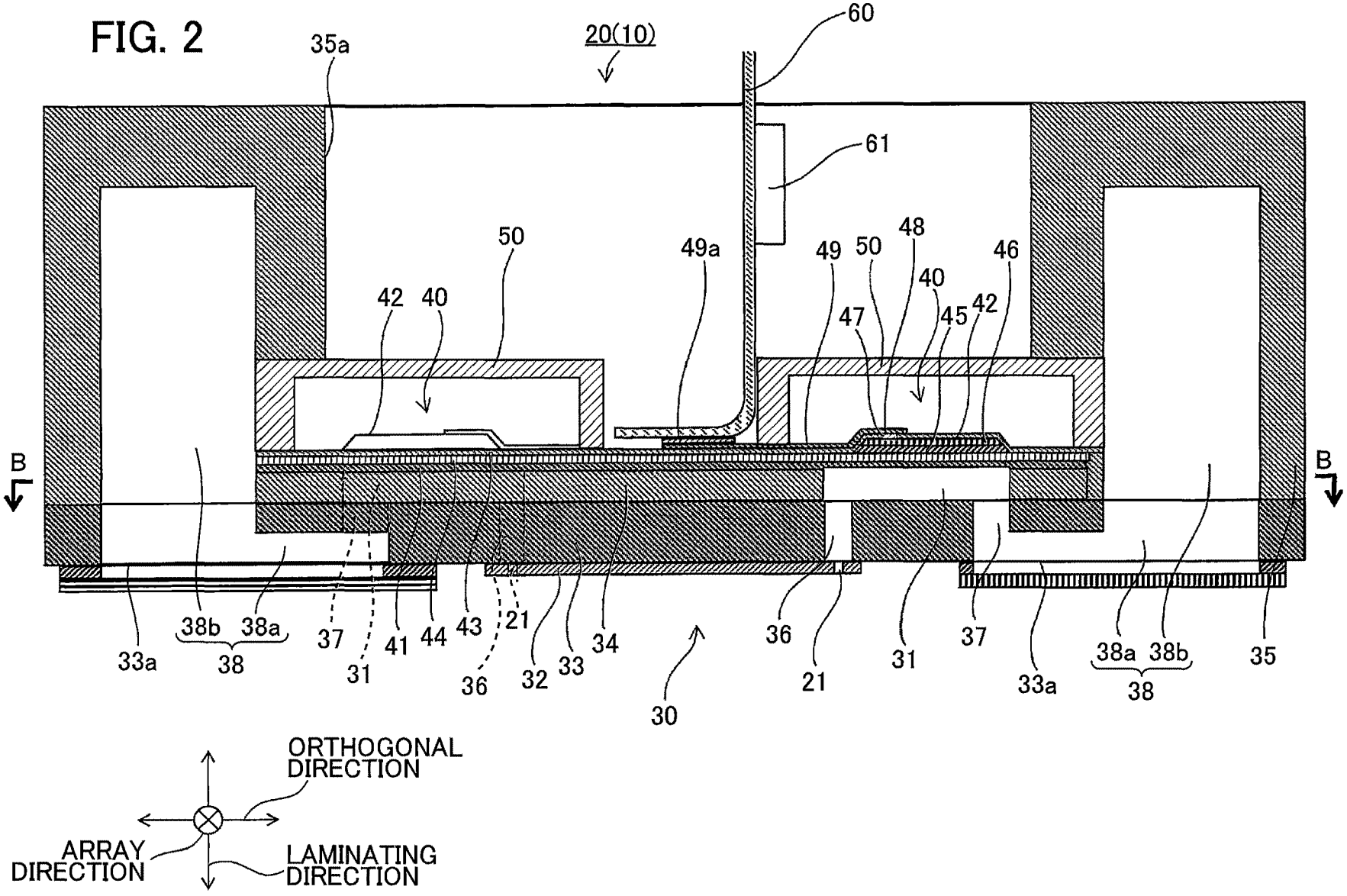
FIG. 2 is a schematic cross-sectional view of a head taken along a line A-A in FIG. 1 in the liquid ejecting device according to the embodiment.

As illustrated in FIG. 2, each head 20 includes a passage board 30, a driver unit 40, a pair of protection members 50 and a COF (chip on film) 60.

The passage board 30 is formed with a plurality of pressure chambers 31 each in communication with each of the plurality of nozzles 21. The plurality of pressure chambers 31 is arranged linearly in the array direction to form a pair of pressure chamber arrays 31*a* each corresponding to each nozzle array 21*a* (see FIG. 3). Specifically, the passage board 30 includes a nozzle plate 32, a passage plate 33, a pressure-chamber plate 34, and a manifold member 35, these being laminated on one after another in an order mentioned above. This direction in which the elements constituting the passage board 30 are laminated ("laminating direction") is perpendicular to the array direction and the orthogonal direction.

The plurality of nozzles 21 extends through a thickness of the nozzle plate 32 in the laminating direction. The nozzles 21 are open on a lower surface of the nozzle plate 32. That is, the lower surface of the nozzle plate 32 serves as the nozzle surface facing the platen 13.

The passage plate 33 is laminated on the nozzle plate 32. The passage plate 33 is formed with a plurality of descenders 36, a plurality of branch passage 37, and a pair of first manifolds 38*a*. Each descender 36 extends through a thickness of the passage plate 33 in the laminating direction so as to communicate with each nozzle 21.

Each of the branch passages 37 connects the corresponding pressure chamber 31 to one of the first manifolds 38*a*. The branch passages 37 extend through the thickness of the passage plate 33 in the laminating direction so as to provide communication between each first manifold 38*a* and the pressure chambers 31 in the corresponding pressure chamber array 31*a*. Each first manifolds 38*a* is a passage to supply liquid to the plurality of pressure chambers 31 in the corresponding pressure chamber array 31*a*. Each first manifold 38*a* extend in the array direction to be in communication with each of the branch passages 37 belonging to the corresponding pressure chamber array 31*a*.

A pair of damper membranes 33*a* is adhered to a lower surface of the passage plate 33 such that each damper membrane 33*a* covers one of the first manifolds 38*a* and the branch passages 37 corresponding thereto. That is, the damper membranes 33*a* partially define the first manifolds 38*a* and the branch passages 37. Each damper membrane 33*a* is a flexible film like member, which is deformable to restrain fluctuation in pressure of the liquid in each first manifold 38*a*.

The pressure chambers 31 extend through a thickness of the pressure-chamber plate 34. Two rows of the pressure chambers 31 (the pair of pressure chamber arrays 31*a*) are formed in the pressure-chamber plate 34 each row corresponding to one of the two nozzle arrays 21*a*. Each pressure chamber 31 provides communication between the corresponding descender 36 and branch passage 37. Thus, each of the pressure chambers 31 is in communication with the corresponding nozzle 21 through the corresponding descender 36, while being in communication with one of the first manifolds 38*a* through the corresponding branch passage 37.

The manifold member 35 is laminated on the passage plate 33. The manifold member 35 is formed with a pair of second manifolds 38*b*. The second manifolds 38*b* are open on a lower surface of the manifold member 35 so as to allow each second manifold 38*b* to communicate with the corresponding one of the first manifolds 38*a*. Thus, each pair of the second manifold 38*b* and the first manifold 38*a* forms a manifold 38 for supplying the liquid into the plurality of pressure chambers 31 in the corresponding pressure chamber array 31*a* through the corresponding branch passages 37. That is, two manifolds 38 are formed in the manifold member 35 each corresponding to each row of the pressure chambers 31 (each pressure chamber array 31*a*).

The driver unit 40 is disposed on the pressure-chamber plate 34. The driver unit 40 includes a diaphragm 41, a plurality of piezoelectric elements 42, and a protection film 43, those being stacked on the pressure-chamber plate 34 in this order.

The diaphragm 41 is laminated on the pressure-chamber plate 34 to cover all the plurality of pressure chambers 31 formed in the pressure-chamber plate 34. The plurality of piezoelectric elements 42 is arranged on the diaphragm 41 in one-to-one correspondence with the plurality of pressure chambers 31. Specifically, two rows of the piezoelectric elements 42 are arranged over the diaphragm 41 in correspondence with the two rows of the pressure chambers 31. That is, each row of the piezoelectric elements 42 corresponds to each pressure chamber array 31*a*.

The piezoelectric elements 42 include a common electrode 44, a piezoelectric substance 45, and a plurality of individual electrodes 46. The common electrode 44 is common for the plurality of piezoelectric elements 42. The common electrode 44 is laminated on the diaphragm 41 so as to cover an entirety of the diaphragm 41. The piezoelectric substance 45 is arranged on the common electrode 44 at a position above the pressure chambers 31. The individual electrodes 46 are positioned on the piezoelectric substance 45. The individual electrodes 46 are provided in one-to-one correspondence with the plurality of pressure chambers 31.

Upon application of a voltage to one the individual electrode 46 corresponding to the nozzle 21 through which the liquid should be ejected, the corresponding piezoelectric substance 45 is deformed to cause a corresponding portion of the diaphragm 41 to be displaced. The displacement of the diaphragm 41 toward the corresponding pressure chamber 31 decreases a volume of the pressure chamber 31, thereby applying pressure to the liquid in the pressure chamber 31. The liquid in the pressure chamber 31 is thus ejected through the corresponding nozzle 21 in communication with the pressure chamber 31.

The protection film 43 is made from aluminum oxide (alumina: $Al_2O_3$), for example. The protection film 43 is formed over the individual electrodes 46 and the common electrode 44 to protect these electrodes 44, 46 against moisture contents. The protection film 43 is formed with through-holes 47 each filled with an electrically conductive material 48. Further, the following is disposed on the protection film 43: a plurality of individual electric conductors 49 each corresponding to each individual electrode 46; and a common terminal (not illustrated) corresponding to the common electrode 44. The electrically conductive materials 48 are provided in one-to-one correspondence with the plurality of individual electric conductors 49. Each individual electric conductor 49 on the protection film 43 and the corresponding individual electrode 46 positioned below the protection film 43 are electrically connected to each other by the corresponding electrically conductive material 48. The common terminal (not shown) on the protection film 43 and the common electrode 44 below the protection film 43 are connected to each other by the corresponding electrically conductive material 48. Each individual electric conductor 49 has a tip end portion provided with an individual terminal 49*a*.

The manifold member 35 has an opening portion 35*a* at a center thereof in the orthogonal direction. The two protection members 50 are positioned at the opening portion 35*a* so as to cover the piezoelectric elements 42 on the diaphragm 41. More specifically, each protection member 50 is provided to cover each row of the piezoelectric elements 42. The individual terminals 49*a* of the individual electric conductors 49 and the common terminal (not shown) appear between the two protection members 50 on the protection film 43.

The COF 60 is a circuit board equipped with a driver IC 61. The COF 60 is positioned between the two protection members 50 in the orthogonal direction. The COF 60 has one end portion electrically connected to each of the individual terminals 49*a* and the common terminal (not shown), and has another end portion electrically connected to the controller 15 (FIG. 1). Hence, the driver IC 61 is configured to generate drive signal(s) for driving one or more of the piezoelectric elements 42 in response to a signal from the controller 15, and transmit the drive signal(s) to the corresponding individual electrode(s) 46 through the corresponding individual terminal(s) 49*a*.

Figure 3:
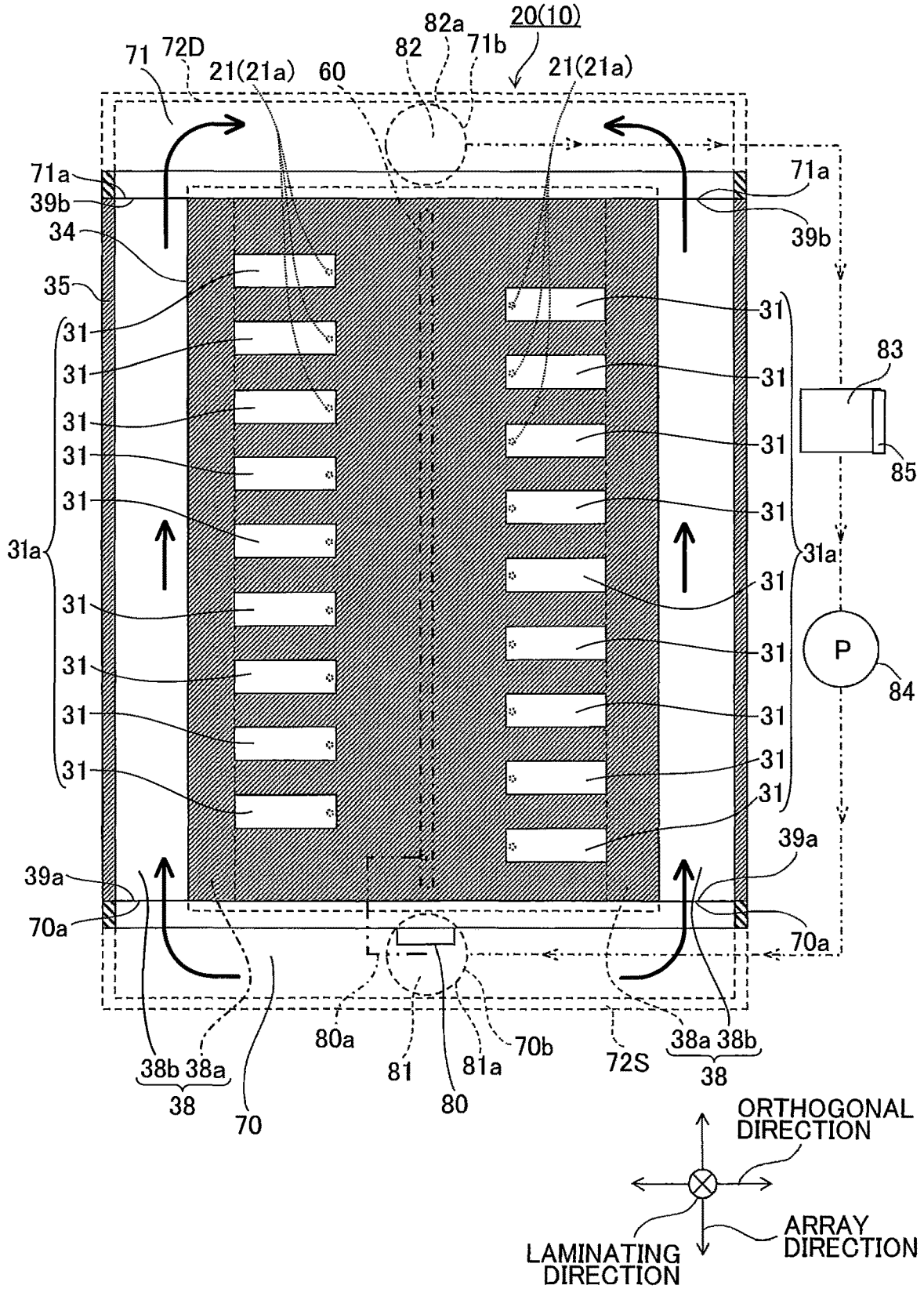
FIG. 3 is a schematic cross-sectional view of the head taken along a line B-B in FIG. 2 in the liquid ejecting device according to the embodiment.
Figure 4:
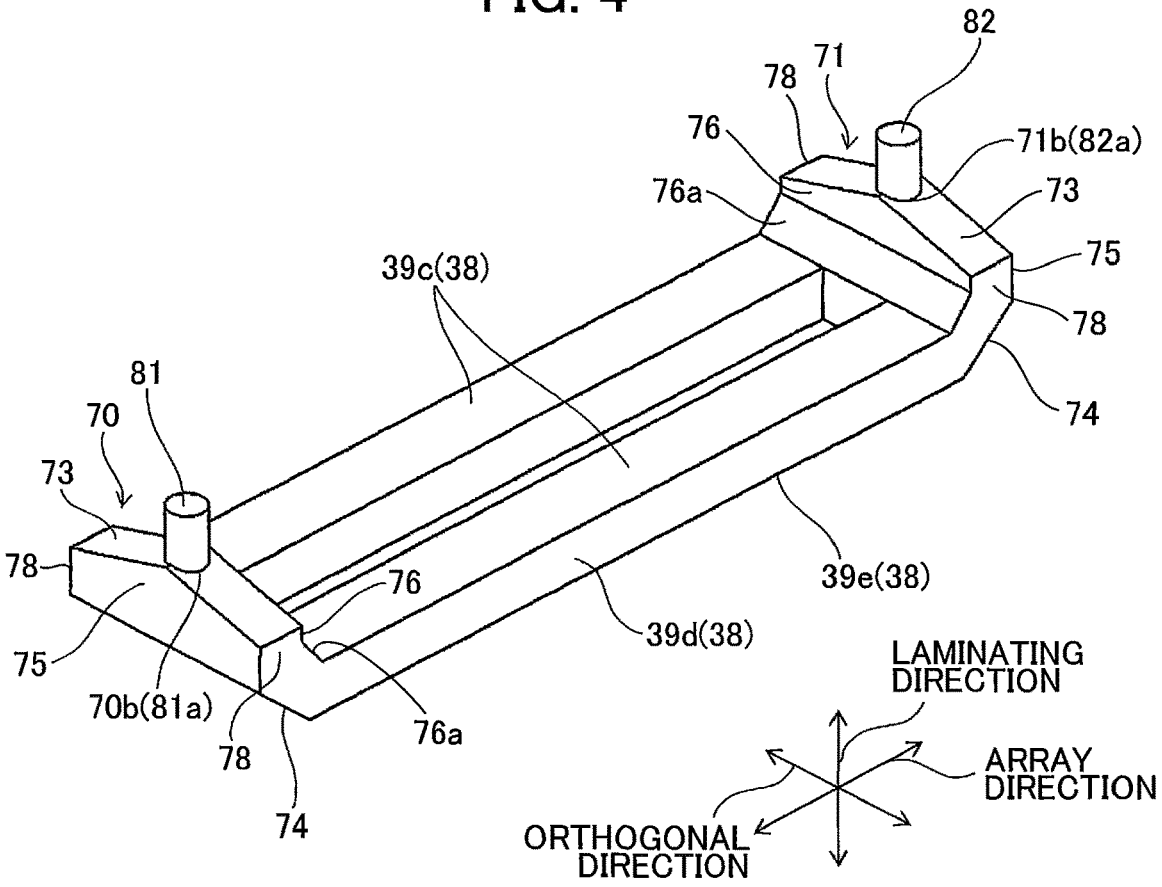
FIG. 4 is a schematic perspective view of manifolds, a supply-side connection passage, a discharge-side connection passage, a supply passage and a discharge passage in the liquid ejecting device according to the embodiment.
Figure 5:
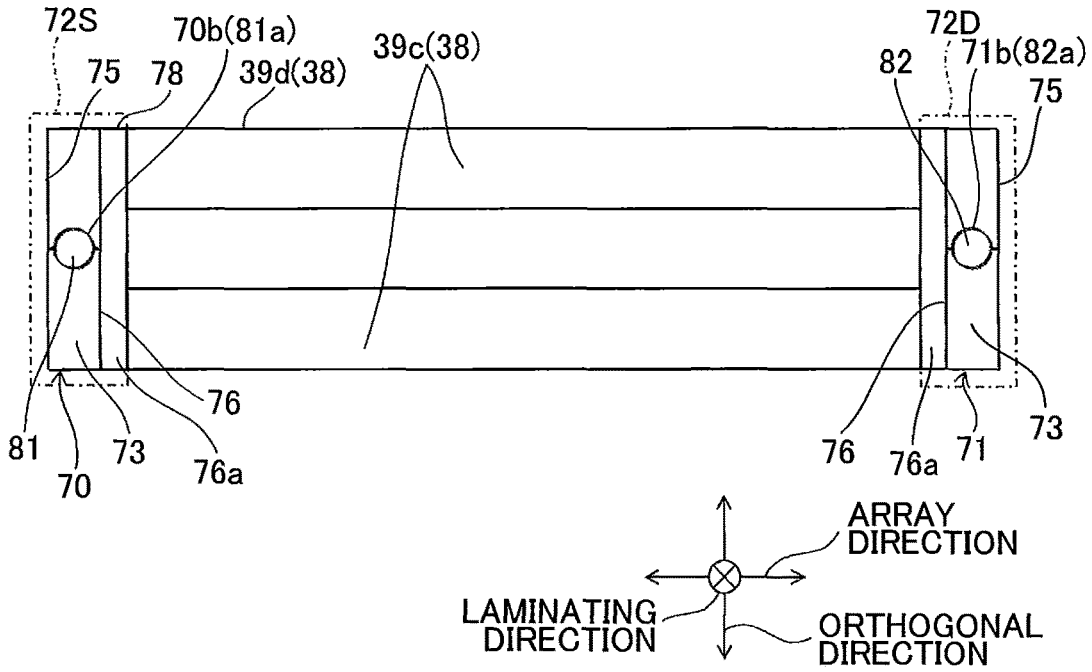
FIG. 5 is a schematic plan view of the manifolds, the supply-side connection passage, the discharge-side connection passage, the supply passage, and the discharge passage those illustrated in FIG. 4.
Figure 6:
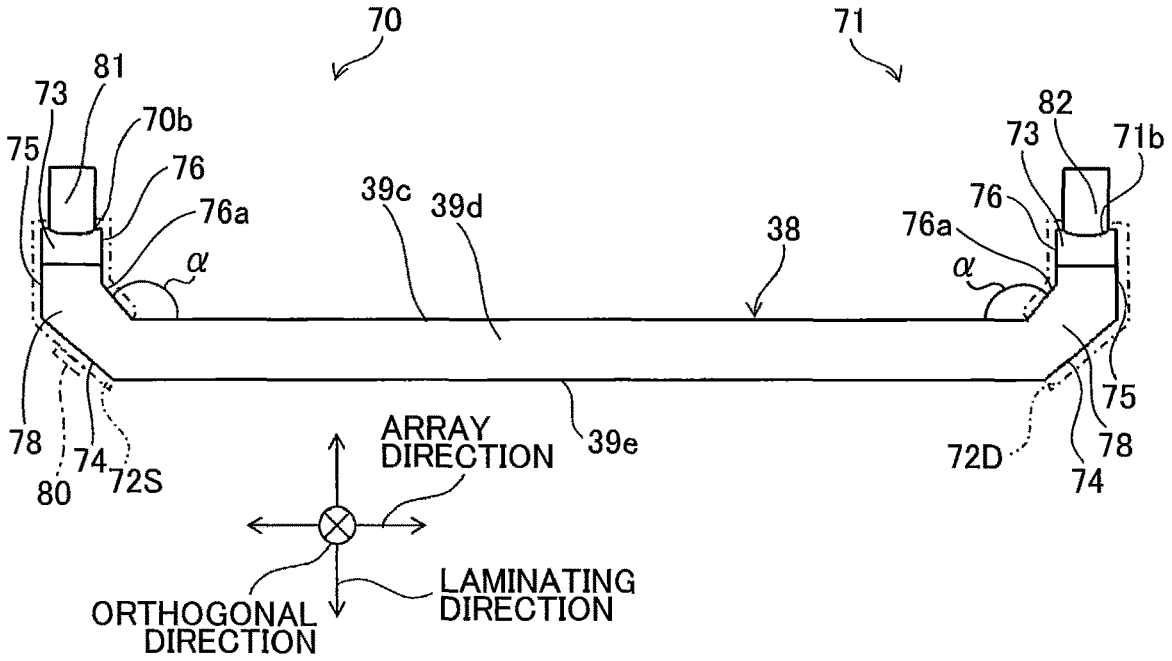
FIG. 6 is a schematic side view of the manifolds, the supply-side connection passage, the discharge-side connection passage, the supply passage, and the discharge passage those illustrated in FIG. 4.

As illustrated in FIG. 3, the plurality of pressure chambers 31 are arrayed in the array direction to constitute the two rows of the pressure chambers 31 (the pair of pressure chamber arrays 31*a*). The two pressure chamber arrays 31*a* are arranged to be spaced apart from each other in the orthogonal direction. The COF 60 is positioned between the two pressure chamber arrays 31*a* in the orthogonal direction. The COF 60 extends in the array direction. Each manifold 38 is positioned opposite to the COF 60 with respect to the corresponding pressure chamber array 31*a*. The two manifolds 38 are connected to each other by connection passages (a supply-side connection passage 70 and a discharge-side connection passage 71), as illustrated in FIGS. 4 to 6. A temperature sensor 80 is disposed at the supply-side connection passage 70 for detecting a temperature of the liquid flowing therethrough. Details of these connection passages 70, 71 will be described later.

Referring to FIGS. 3 and 4, a supply passage 81 is connected to the supply-side connection passage 70, while a discharge passage 82 is connected to the discharge-side connection passage 71. The supply passage 81 has one end (formed with a supply opening 81*a*) connected to the supply-side connection passage 70, and has another end connected to a tank 83. A pump 84 is provided at a path connecting the tank 83 to the supply passage 81 (the path is indicated by a phantom line in FIG. 3). The discharge passage 82 has one end (formed with a discharge opening 82*a*) connected to the discharge-side connection passage 71, and has another end connected to the tank 83. The tank 83 stores therein the liquid, and a heater 85 is provided at the tank 83 for heating the liquid stored in the tank 83. The heater 85 is electrically connected to the controller 15 (FIG. 1) through the COF 60.

The liquid in the tank 83 is allowed to flow into the supply-side connection passage 70 through the supply passage 81 by the pump 84. The liquid is then distributed into the plurality of (two) manifolds 38 from the supply-side connection passage 70, and is then distributed into the respective pressure chambers 31 from the manifolds 38, and is finally ejected from the nozzles 21 in communication with the pressure chambers 31. Residual liquid, which has not been ejected through the nozzles 21, is flowed out from the plurality of (two) manifolds 38 into the discharge-side connection passage 71, and is then discharged into the discharge passage 82 from the discharge-side connection passage 71, and is finally returned into the tank 83. In this way, the liquid is circulated between the tank 83 and the two manifolds 38 through the supply passage 81 and discharge passage 82. Accordingly, the temperature of the liquid in the two manifolds 38 becomes uniform, so that a uniform amount of liquid can be ejected from the nozzles 21 in communication with these manifolds 38. Hereinafter, a direction in which the liquid circulates in the head 20 (from the tank 83 to the manifolds 38 through the supply-side connection passage 70 and back into the tank 83 from the manifolds 38 through the discharge-side connection passage 71) will be referred to as "liquid-flow direction". The liquid-flow direction is indicated by thick arrows in FIG. 3.

As the liquid circulates in the liquid-flow direction, the temperature sensor 80 is configured to detect the temperature of the liquid flowing through the supply-side connection passage 70 and the detected temperature is configured to be outputted to the controller 15 through the COF 60. The controller 15 is configured to control operations of the heater 85 based on the detected temperature. The liquid can be heated by the heater 85 up to a temperature that can provide an optimum viscosity of the liquid so that a desired amount of the liquid can be ejected from the nozzles 21. For example, in case that the liquid is UV ink whose viscosity is relatively high, a desired amount of UV ink can be ejected through the nozzles 21 by lowering the viscosity of the UV ink by way of heating.

<Connection Passages>

As illustrated by broken lines in FIGS. 3, 5 and 6, the supply-side connection passage 70 is defined by a supply-side connection passage forming member 72 ("forming member 72S", hereinafter). Likewise, the discharge-side connection passage 71 is defined by a discharge-side connection passage forming member 72 ("forming member 72D", hereinafter), as illustrated by a phantom line in FIGS. 3, 5 and 6. The forming member 72D has a symmetrical shape to the forming member 72S.

Precisely speaking, the supply-side connection passage 70 is a hollow space (liquid channel) defined by inner surfaces of the forming member 72S; and the discharge-side connection passage 71 is a hollow space (liquid channel) defined by inner surfaces of the forming member 72D. However, for simplifying description, those inner surfaces of the forming members 72S and 72D defining the supply-side connection passage 70 and discharge-side connection passage 71 will be described as belonging to the supply-side connection passage 70 and discharge-side connection passage 71, respectively. And, in the attached drawings, those inner surfaces of the forming members 72S and 72D defining the supply-side connection passage 70 and discharge-side connection passage 71 will be depicted by solid lines, while the forming members 72S and 72D will be depicted by phantom lines in order to facilitate understanding of the disclosure.

As illustrated in FIG. 3, the supply-side connection passage 70 has a plurality of connection openings 70*a* each in communication with an inlet opening 39*a* of each manifold 38. According to the depicted embodiment, since two manifolds 38 are provided, two connection openings 70*a* are provided in the supply-side connection passage 70 in correspondence with the two inlet openings 39*a* of the two manifolds 38. The two connection openings 70*a* are positioned spaced away from each other in the orthogonal direction. Each connection opening 70*a* is open in the array direction. That is, the supply-side connection passage 70 is in communication with each of the manifolds 38 through the corresponding supply-side connection opening 70*b* and inlet opening 39*a*.

Further, the supply-side connection passage 70 provides a single supply-side connection opening 70*b* positioned at a center in the orthogonal direction between the two connection openings 70*a*. The supply-side connection opening 70*b* is open in the laminating direction. The supply-side connection passage 70 is in communication with the supply passage 81 through the supply-side connection opening 70*b* and the supply opening 81*a* (see FIG. 4).

The discharge-side connection passage 71 has a symmetrical shape to the supply-side connection passage 70. Specifically, referring to FIG. 3, the discharge-side connection passage 71 has a plurality of connection openings 71*a* each in communication with an outlet opening 39*b* of each manifold 38. According to the depicted embodiment, since two manifolds 38 are provided, two connection openings 71*a* are provided corresponding to two outlet openings 39*b* of the two manifolds 38. The two connection openings 71*a* are positioned away from each other in the orthogonal direction. The connection openings 71*a* are open in the array direction. The discharge-side connection passage 71 is thus in communication with each of the manifolds 38 through the corresponding outlet opening 39*b* and connection opening 71*a*.

Further, the discharge-side connection passage 71 provides a single discharge-side connection opening 71*b* positioned at a center in the orthogonal direction between the two connection openings 71*a*. The discharge-side connection opening 71*b* is open in the laminating direction. The discharge-side connection passage 71 is in communication with the discharge passage 82 through the discharge-side connection opening 71*b* and discharge opening 82*a* (see FIG. 4).

Each of the supply-side connection passage 70 and discharge-side connection passage 71 is connected to each end of each manifold 38 in the array direction. Each manifold 38 extends in the array direction such that each end of the manifold 38 in the array direction (inlet opening 39*a*, outlet opening 39*b*) is positioned outward of each row of the pressure chambers 31 (each pressure chamber array 31*a*) in the array direction. That is, the connection passages 70, 71 are positioned outward of a region in which the pressure chambers 31 are formed in the array direction. Hence, the liquid can smoothly flow through the manifolds 38 within the region in which the pressure-chamber 31 are formed, and consequently, the liquid can be uniformly ejected from the nozzles 21 in communication with the manifolds 38.

The temperature sensor 80 is provided at the supply-side connection passage 70 (also see FIG. 6). Since the supply-side connection passage 70 is positioned downstream of the supply passage 81 and immediately upstream of the two manifolds 38 in the liquid-flow direction, the temperature sensor 80 can detect the temperature of the liquid in the supply-side connection passage 70 immediately before the liquid branches into the two manifolds 38. That is, the temperature sensor 80 can detect the temperature of the liquid in the supply-side connection passage 70 that is positioned closer to the nozzles 21 than the supply passage 81 is to the nozzles 21. Consequently, the temperature sensor 80 can detect the liquid temperature which can be approximated to the temperature of the liquid in the nozzles 21.

The temperature sensor 80 detects the temperature of the liquid to be supplied to the nozzles 21 in communication with the manifolds 38. Since the supply-side connection passage 70 allows the liquid to flow into the manifolds 38 and the temperature sensor 80 is provided at the supply-side connection passage 70, the temperature sensor 80 can detect the liquid temperature which can be approximated to the temperature of the liquid in the nozzles 21.

The temperature sensor 80 is disposed at the supply-side connection passage 70 at a position the same as the position of the supply opening 81*a* in the array direction, so that the temperature sensor 80 is positioned to be coincident with the supply opening 81*a* in the array direction. That is, the temperature sensor 80 is aligned with the supply opening 81*a* in the laminating direction. With this positional relationship, the temperature sensor 80 detects the temperature of the liquid that has flown into the supply-side connection passage 70 through the supply opening 81*a* and that will be supplied to the two manifolds 38. Hence, the temperature sensor 80 can detect an average temperature of the liquid that will be flowing into the two manifolds 38 without any imbalance between the two manifolds 38.

The temperature sensor 80 is electrically connected to the COF 60 by a lead wire 80*a* (see FIG. 3). The temperature sensor 80 is positioned at an outer surface of the forming member 72S. Hence, the temperature sensor 80 is positioned upstream of the manifolds 38 in the liquid-flow direction. Accordingly, a complexed wiring to the temperature sensor 80 can be avoided, leading to a reduction in production cost. Further, since the temperature sensor 80 appears at the outside of the forming member 72S, the temperature sensor 80 can be electrically connected to the COF 60 easily, and hence, electrical connection of the temperature sensor 80 to the controller 15 through the COF 60 can be facilitated.

Next, the supply-side connection passage 70 and discharge-side connection passage 71 will be described in details with reference to FIGS. 4 through 6. In these drawings, components other than the temperature sensor 80, the manifolds 38, the supply-side connection passage 70, the discharge-side connection passage 71, the forming members 72S and 72D, the supply passage 81, and the discharge passage 82 are omitted for simplicity.

Note that, the supply-side connection passage 70 and the discharge-side connection passage 71 will be simply referred to as "connection passage 70, 71" in a case where clear distinction between the "supply side" and the "discharge side" is deemed unnecessary. Further, one side and another side in the laminating direction will be referred to as "upper side" and "lower side", respectively, for the sake of convenience. However, orientation of the liquid ejecting device 10 is not limited to this direction.

Each connection passage 70, 71 is defined by a top surface 73, a bottom surface 74, a pair of end surfaces (an outer end face 75 and an inner end face 76), and a pair of side surfaces 78 of the forming member 72S, 72D. Since the forming member 72D has the symmetrical shape with the forming member 72S, description will be given mainly for the forming member 72S, hereinafter.

The top surface 73 is positioned higher than a top surface 39*c* of each manifold 38 in the laminating direction. Further, the top surface 73 has an inverted V-shape sloping downward in a direction away from a center of the top surface 73 in the orthogonal direction. The supply-side connection opening 70*b*, which communicates with the supply opening 81*a* of the supply passage 81, is positioned at the center of the top surface 73 in the orthogonal direction.

With respect to the top surface 73 of the discharge-side connection passage 71, the discharge-side connection opening 71*b* communicates with the discharge opening 82*a* of the discharge passage 82.

The bottom surface 74 is a sloped surface sloping diagonally downward from a lower end of the outer end surface 75 toward the manifolds 38. In other words, the bottom surface 74 is sloped diagonally downward from the supply opening 81*a* of the supply passage 81 toward the inlet opening 29*a* of each manifold 38. Further, the bottom surface 74 is connected continuously to a bottom surface 39*e* of each manifold 38. Accordingly, the liquid can flow smoothly along the sloped bottom surface 74 to the bottom surfaces 39*e*, thereby reducing precipitation of substances such as pigment contained in the liquid such as ink.

Each side surface 78 is perpendicular to the orthogonal direction, and is flush with an outer side surface 39*d* of the corresponding manifold 38.

The outer end face 75 is positioned farther away from the manifolds 38 than the inner end face 76 is from the manifolds 38 in the array direction. The outer end surface 75 extends perpendicularly to the array direction. The outer end surface 75 connects the top surface 73 to the bottom surface 74. The inner end face 76 connects the top surface 73 to the top surface 39*c* of each manifold 38. The inner end surface 76 has an upper portion extending perpendicularly to the array direction, and a lower portion 76*a* sloping diagonally downward toward the manifolds 38. The lower portion 76*a* is sloped diagonally downward from the supply opening 81*a* of the supply passage 81 toward the inlet opening 39*a* of each manifold 38. The lower portion 76*a* is connected continuously to the top surface 39*c* of each manifold 38. An angle $\alpha$ defined between the lower portion 76*a* and each top surface 39*c* (see FIG. 6) is an obtuse angle, and no stepped portion is provided between the lower portion 76*a* and each top surface 39*c*. With this structure, bubbles contained in the liquid flowing from the supply-side connection passage 70 toward the manifolds 38 can be prevented from being stagnated at a connecting portion between the lower portion 76*a* and the top surface 39*c* of each manifold 38. Consequently, this structure can restrain defective ejection of liquid through the nozzles 21 due to entry of stagnated and enlarged bubbles into the nozzles 21.

The temperature sensor 80 is disposed at the forming member 72S in a range defined between the top surface 39*c* and the bottom surface 39*e* in the laminating direction. The temperature sensor 80 is disposed at a portion of the forming member 72S, the portion corresponding to the bottom surface 74 and being aligned with the supply passage 81 in the laminating direction. Since the temperature of the liquid near the bottom surface 74 is close to the temperature of the liquid in the manifolds 38, the temperature sensor 80 can detect a liquid temperature approximating to the temperature of the liquid in the nozzles 21.

Further, the bottom surface 74 is positioned farther away from the supply passage 81 than the outer end surface 75 is from the supply passage 81. Hence, a flow velocity of the liquid flowing along the bottom surface 74 is not excessively high. Further, the liquid can flow smoothly along the bottom surface 74 because of the inclination of the bottom surface 74, thereby avoiding stagnation of the liquid at the bottom surface 74. In this way, the temperature sensor 80 provided at the portion of the forming member 72 corresponding to the bottom surface 74 can reliably detect the temperature of the liquid flowing along the bottom surface 74.

Further, the temperature sensor 80 is positioned between the two manifolds 38 in the orthogonal direction, and at the portion of the forming member 72 defining the supply-side connection passage 70 that is common to the two manifolds 38. Therefore, even if an amount of liquid flowing into one of the manifolds 38 is different from an amount of liquid flowing into remaining one of the manifolds 38, this structure of the embodiment can reduce discrepancy between the temperature detected by the temperature sensor 80 and the temperature of the liquid in the nozzles 21 in communication with the manifolds 38.

[Modifications]

Hereinafter, various modifications to the depicted embodiment will be described. In the following description, like parts and components are designated by the same reference numerals as those in the above-described embodiment. Further, as in the depicted embodiment, for the sake convenience, those surfaces defining each supply-side connection passage (inner surfaces of the forming member 72S) are illustrated in solid lines in FIGS. 7 through 13.

<Modification 1>

Figure 7:
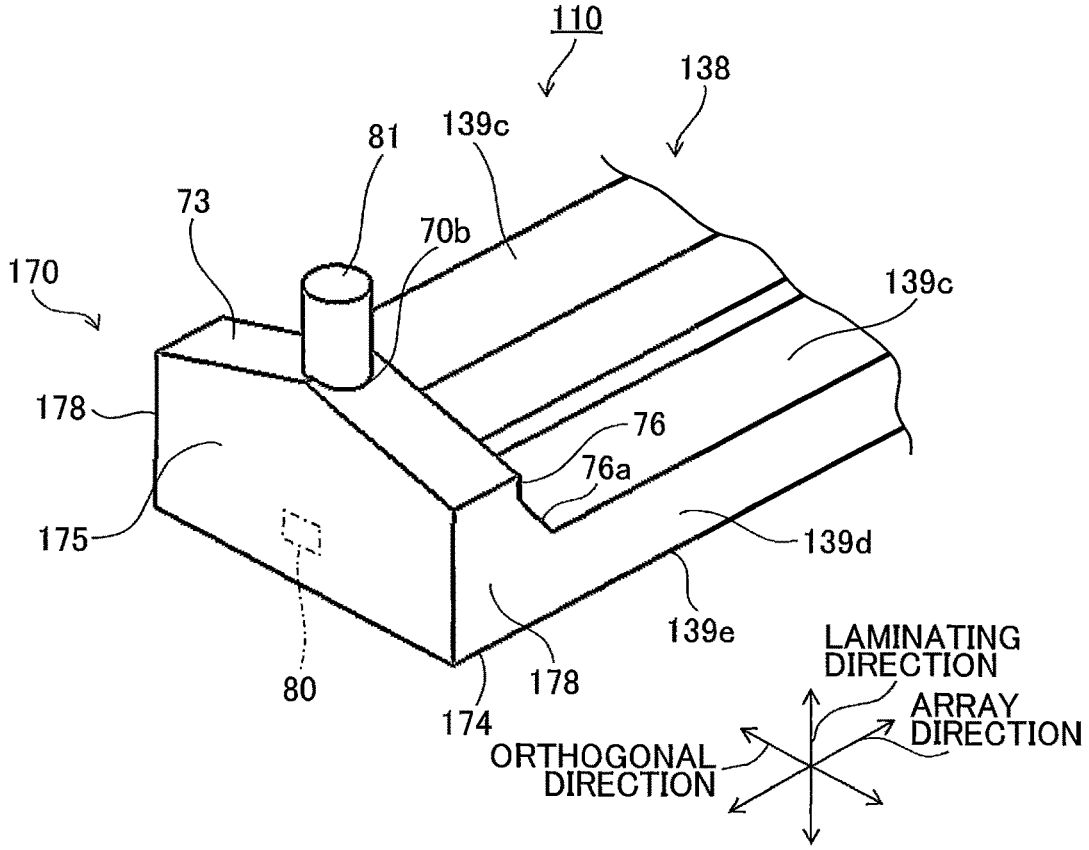
FIG. 7 is a schematic perspective view of manifolds, a supply-side connection passage, and a supply passage in a liquid ejecting device according to a first modification.

A liquid ejecting device 110 according to a first modification will be described with reference to FIG. 7.

The liquid ejecting device 110 includes a supply-side connection passage 170, a pair of manifolds 138, and the supply passage 81. Note that a discharge-side connection passage provided in the liquid ejecting device 110 is not illustrated in FIG. 7 and description therefor will be omitted, since the discharge-side connection passage has a symmetrical structure to the supply-side connection passage 170.

In the depicted embodiment, the supply-side connection passage 70 has the sloped bottom surface 74. In contrast, in the first modification, the supply-side connection passage 170 has a bottom surface 174 that is not inclined relative to the array direction.

Specifically, the supply-side connection passage 170 has the top surface 73, the inner end face 76, an outer end surface 175, the bottom surface 174, and a pair of side surfaces 178. The outer end surface 175 is a flat surface extending perpendicular to the array direction. The outer end surface 175 extends from the top surface 73 downward to a position equal to a position of the bottom surface 139*e* of each manifold 138 in the laminating direction. Each side surface 178 is in flush with an outer side surface 139*d* of the corresponding manifold 138.

The bottom surface 174 extends from a lower edge of the outer end surface 175 in the array direction toward the manifolds 138. The bottom surface 174 is a flat surface extending in the array direction and is flush with the bottom surface 139*e* of each manifold 138. Since the bottom surface 174 is not inclined, the supply-side connection passage 170 can have a reduced dimension in the array direction. Thus, the liquid ejecting device 110 can be made compact.

<Modification 2>

Figure 8:
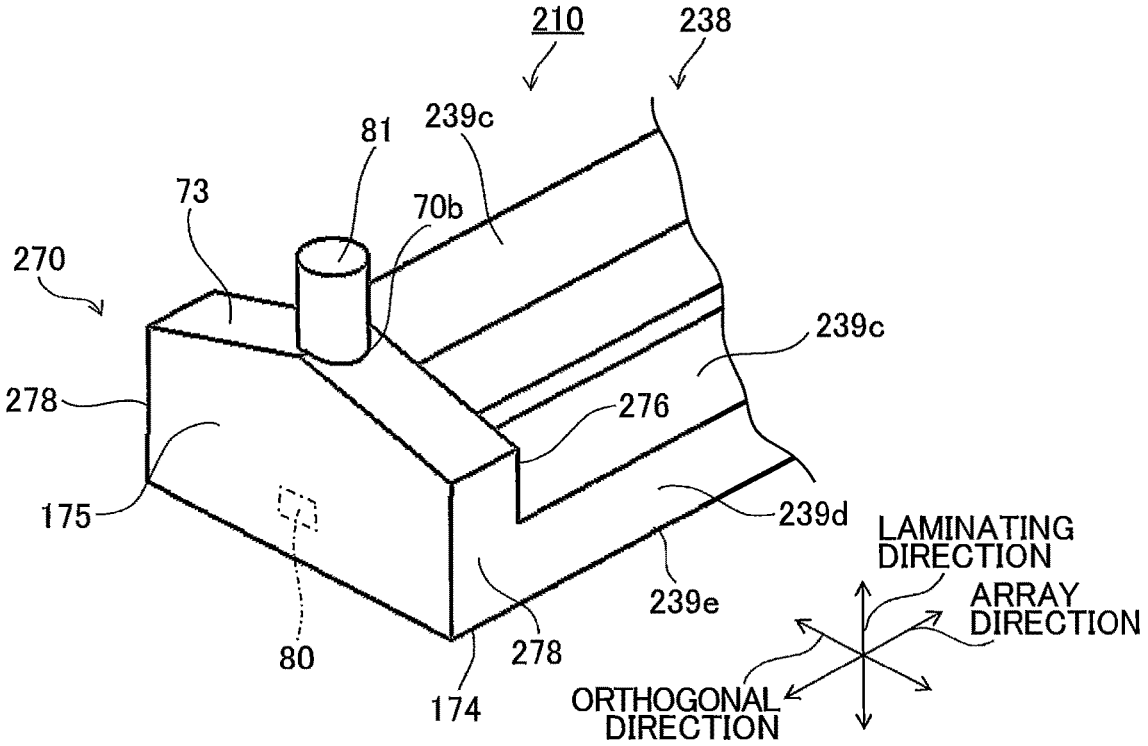
FIG. 8 is a schematic perspective view of manifolds, a supply-side connection passage, and a supply passage in a liquid ejecting device according to a second modification.

A liquid ejecting device 210 according to a second modification will be described with reference to FIG. 8.

The liquid ejecting device 210 includes a supply-side connection passage 270, a pair of manifolds 238, and the supply passage 81. Note that a discharge-side connection passage provided in the liquid ejecting device 210 is not illustrated in FIG. 8 and description therefor will be omitted, since the discharge-side connection passage has a symmetrical structure to the supply-side connection passage 270.

In the depicted embodiment and the first modification, the lower portion 76*a* of the inner end face 76 is inclined relative to the array direction. In contrast, the supply-side connection passage 270 according to the second modification has an inner end face 276 that does not include a lower inclined portion.

Specifically, the supply-side connection passage 270 has the top surface 73, the outer end surface 175, the bottom surface 174, the inner end surface 276, and a pair of side surfaces 278. The inner end face 276 extends perpendicular to the array direction, and does not have any portion inclined relative to the array direction. Hence, the inner end face 276 extends from the top surface 73 down to a position equal to a position of a top surface 239*c* of each manifold 238 in the laminating direction. That is, the outer end surface 175 and inner end face 276 are parallel to each other. Each side surface 278 is in flush with an outer side surface 239*d* of the corresponding manifold 238. The bottom surface 174 is in flush with a bottom surface 239*e* of each manifold 238. Since the inner end surface 276 is not inclined, the supply-side connection passage 270 can have a reduced dimension in the array direction. Thus, the liquid ejecting device 210 can be made compact.

<Modification 3>

Figure 9:
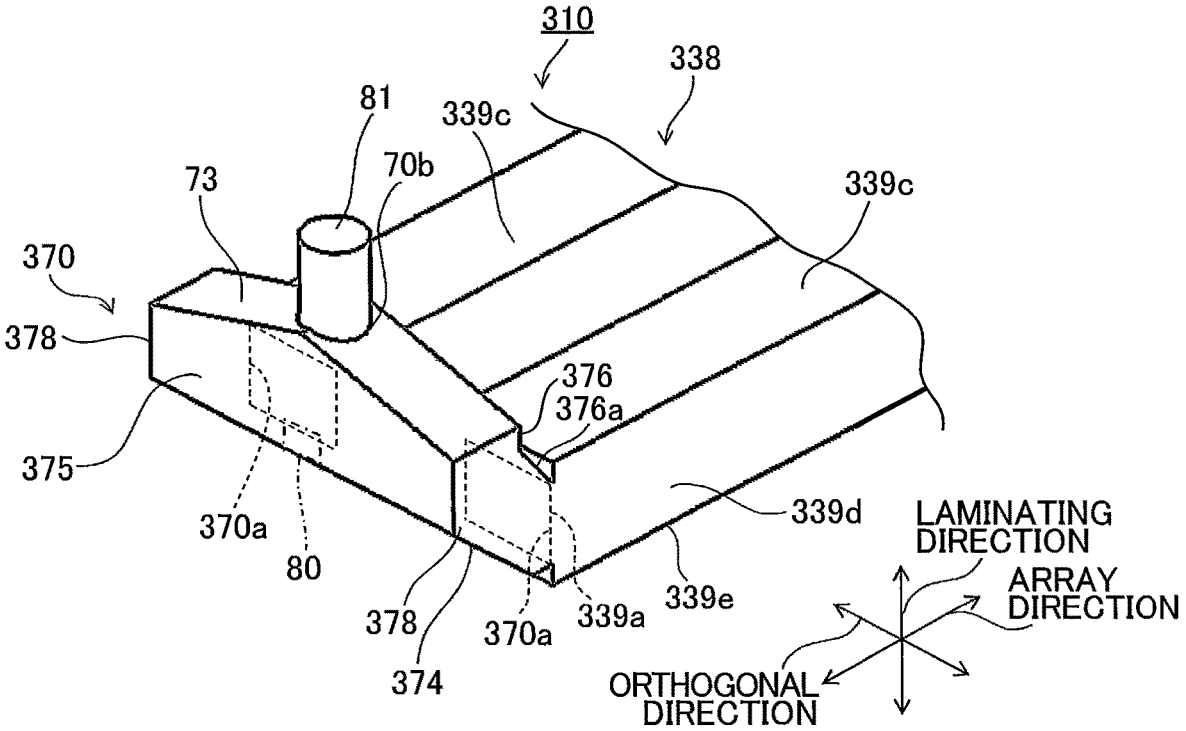
FIG. 9 is a schematic perspective view of manifolds, a supply-side connection passage, and a supply passage in a liquid ejecting device according to a third modification.

A liquid ejecting device 310 according to a third modification will be described with reference to FIG. 9.

The liquid ejecting device 310 includes a supply-side connection passage 370, a pair of manifolds 338, and the supply passage 81. Note that a discharge-side connection passage provided in the liquid ejecting device 310 is not illustrated in FIG. 9 and description therefor will be omitted, since the discharge-side connection passage has a symmetrical structure to the supply-side connection passage 370.

In the supply-side connection passage 70, 170, 270 of the above-described embodiment and the first and second modifications, the inner end face 76, 276 is continuously connected to the top surface 39*c*, 139*c*, 239*c* of each manifold 38, 138, 238, respectively, without any steps formed therebetween. The bottom surface 74, 174 is also continuously connected to the bottom surface 39*e*, 139*e*, 239*e* of each manifold 38, 138, 238, respectively, so as to be in flush therewith.

On the other hand, in the supply-side connection passage 370 according to the third modification, an inner end surface 376 thereof is connected to a top surface 339*c* of each manifold 338 with a stepped portion provided therebetween. Likewise, a bottom surface 374 of the supply-side connection passage 370 is connected to a bottom surface 339*e* of each manifold 338 with a stepped portion provided therebetween.

Specifically, the supply-side connection passage 370 has the top surface 73, an outer end surface 375, the bottom surface 374, the inner end surface 376, and a pair of side surfaces 378. The bottom surface 374 is sloped relative to the array direction as in the embodiment, but a lower edge of the bottom surface 374 is positioned higher than the bottom surface 339*e* of each manifold 338 in the laminating direction. The inner end surface 376 has a sloped lower portion 376*a* as in the embodiment, but a lower edge of the lower portion 376*a* is positioned lower than the top surface 339*c* of each manifold 338 in the laminating direction. In this way, a stepped portion is formed between the supply-side connection passage 370 and the manifolds 338. Note that each connection opening 370*a* of the supply-side connection passage 370 is in communication with an inlet opening 339*a* of the corresponding manifold 338. Each side surface 378 is in flush with an outer side surface 339*d* of the corresponding manifold 338.

<Modification 4>

Figure 10:
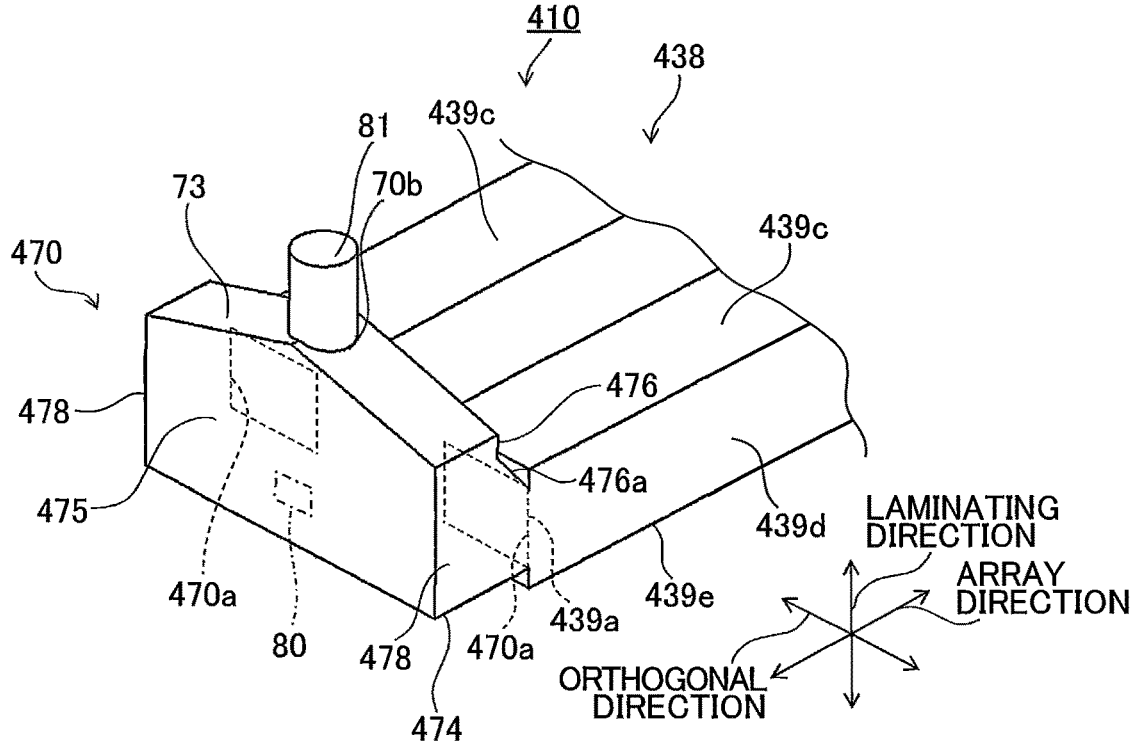
FIG. 10 is a schematic perspective view of manifolds, a supply-side connection passage, and a supply passage in a liquid ejecting device according to a fourth modification.

A liquid ejecting device 410 according to a fourth modification will be described with reference to FIG. 10.

The liquid ejecting device 410 includes a supply-side connection passage 470, a pair of manifolds 438, and the supply passage 81. Note that a discharge-side connection passage provided in the liquid ejecting device 410 is not illustrated in FIG. 10 and description therefor will be omitted, since the discharge-side connection passage has a symmetrical structure to the supply-side connection passage 470.

The fourth modification is similar to the third modification in that a stepped portion is provided between the supply-side connection passage 470 and each manifold 438.

Specifically, the supply-side connection passage 470 has the top surface 73, an outer end surface 475, a bottom surface 474, an inner end surface 476, and a pair of side surfaces 478. The inner end surface 476 has a sloped lower portion 476*a*, and a lower edge of the lower portion 476*a* is positioned lower than a top surface 439*c* of each manifold 438 in the laminating direction, as in the third modification.

However, the bottom surface 474 is not a sloped surface, unlike the bottom surface 374 of the third modification. The bottom surface 474 is a flat surface orthogonal to the outer end surface 475. The bottom surface 474 is positioned higher than a bottom surface 439*e* of each manifold 438 in the laminating direction. As in the third modification, each connection opening 470*a* of the supply-side connection passage 470 is in communication with an inlet opening 439*a* of the corresponding manifold 438. Each side surface 478 is in flush with an outer side surface 439*d* of the corresponding manifold 438.

<Modification 5>

Figure 11:
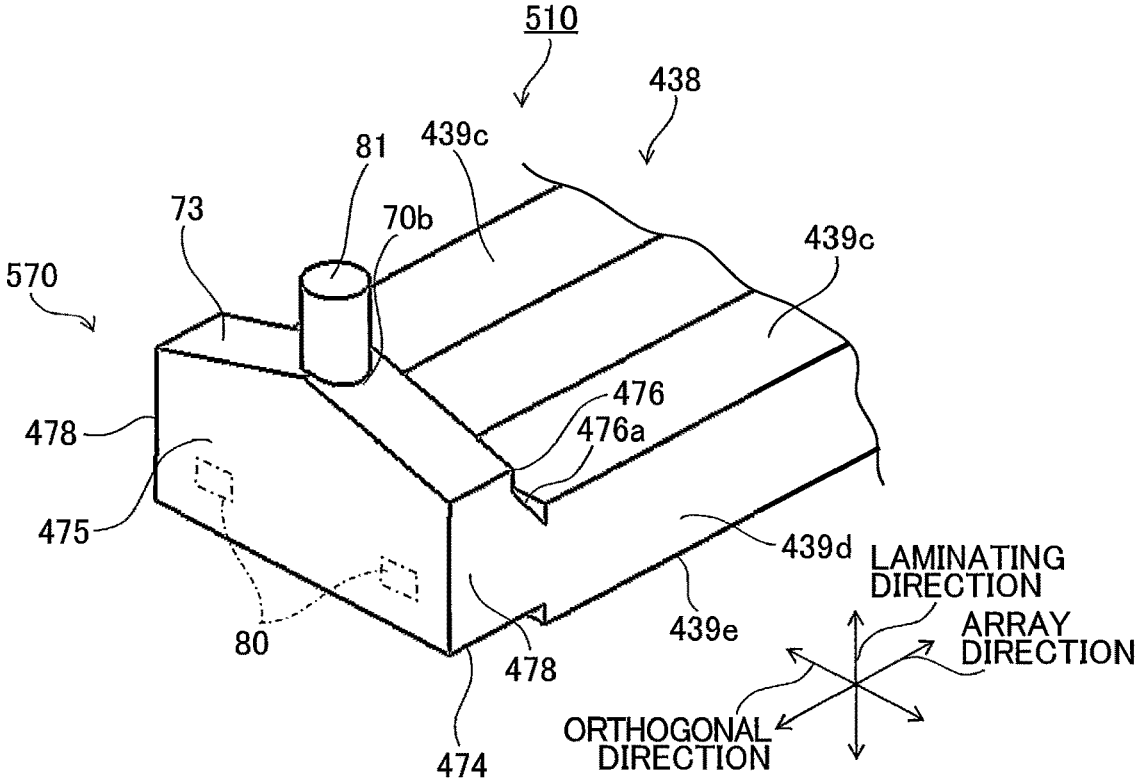
FIG. 11 is a schematic perspective view of manifolds, a supply-side connection passage, and a supply passage in a liquid ejecting device according to a fifth modification.

A liquid ejecting device 510 according to a fifth modification will be described with reference to FIG. 11.

The liquid ejecting device 510 includes a supply-side connection passage 570, the pair of manifolds 438, and the supply passage 81. Note that a discharge-side connection passage provided in the liquid ejecting device 510 is not illustrated in FIG. 11 and description therefor will be omitted, since the discharge-side connection passage is symmetrically shaped to the supply-side connection passage 570.

The fifth modification is similar to the fourth modification in terms of configurations of the manifolds 438, the supply passage 81, and the supply-side connection passage 570. However the fifth modification is different from the above-described embodiment and foregoing modifications in terms of the number of temperature sensors 80. Specifically, while the single temperature sensor 80 is provided at the supply-side connection passage 70, 170, 270, 370, 470 for the plurality of manifolds 38, 138, 238, 338, 438 in the above-described embodiment and foregoing modifications, a plurality of (two) temperature sensors 80 is provided at the supply-side connection passage 570 in one-to-one correspondence with the plurality of (two) manifolds 438 in the fifth modification.

More specifically, in the supply-side connection passage 570, the two temperature sensors 80 are provided on a portion of a supply-side connection passage forming member (not illustrated) defining the supply-side connection passage 570 such that each temperature sensor 80 is positioned to correspond to each manifold 438 in the array direction. That is, each temperature sensor 80 is arranged to be aligned with each manifold 438 in the array direction.

<Modification 6>

Figure 12:
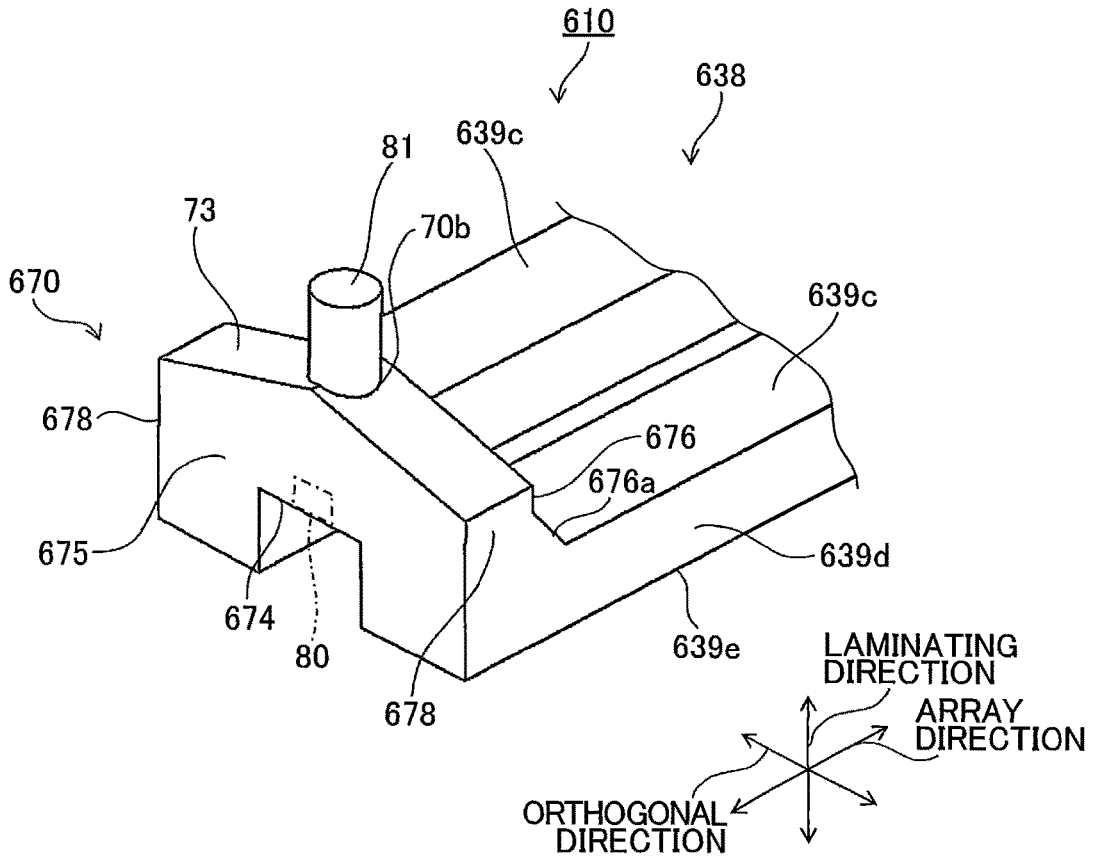
FIG. 12 is a schematic perspective view of manifolds, a supply-side connection passage, and a supply passage in a liquid ejecting device according to a sixth modification.

A liquid ejecting device 610 according to a sixth modification will be described with reference to FIG. 12.

The liquid ejecting device 610 includes a supply-side connection passage 670, a pair of manifolds 638, and the supply passage 81. Note that a discharge-side connection passage provided in the liquid ejecting device 610 is not illustrated in FIG. 12 and description therefor will be omitted, since the discharge-side connection passage has a symmetrical structure to the supply-side connection passage 670.

According to the embodiment and the foregoing modifications, the supply-side connection passage 70, 170, 270, 370, 470, 570 is positioned outward relative to the manifolds 38, 138, 238, 338, 438 in the array direction. In contrast, according to the sixth modification, the supply-side connection passage 670 is positioned above the manifolds 638 in the laminating direction.

Specifically, the supply-side connection passage 670 has the top surface 73, an outer end surface 675, an inner end face 676, a bottom surface 674, and a pair of side surfaces 678. The outer end surface 675 is perpendicular to the array direction. The inner end face 676 has a sloped lower portion 676*a* that is connected continuously to a top surface 639*c* of each manifold 638. The bottom surface 674 is positioned at the same height as, or higher than the top surface 639C of each manifold 638 in the laminating direction. The bottom surface 674 is thus positioned higher than a bottom surface 639*e* of each manifold 638. Each side surface 678 is in flush with an outer side surface 639*d* of each manifold 638. Therefore, the resultant liquid ejecting device 610 can be compact in the array direction.

<Modification 7>

Figure 13:
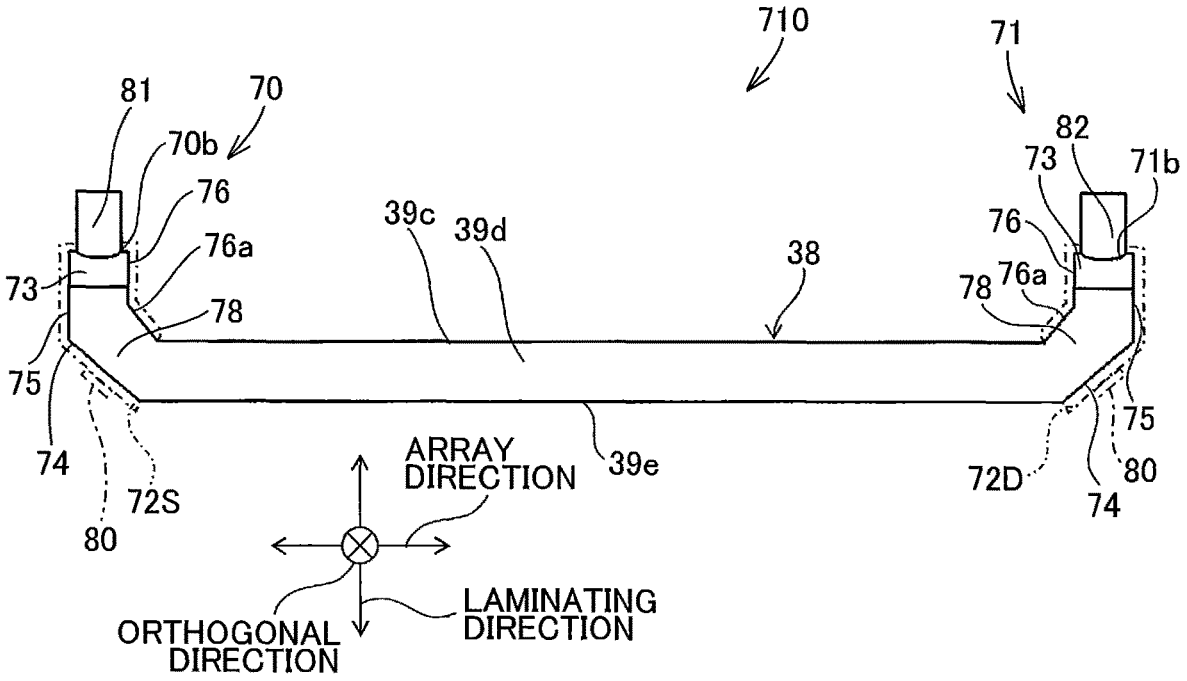
FIG. 13 is a schematic side view of manifolds, a supply-side connection passage, a discharge-side connection passage, a supply passage, and a discharge passage in a liquid ejecting device according to a seventh modification.

A liquid ejecting device 710 according to a seventh modification will be described with reference to FIG. 13.

According to the above-described embodiment and the foregoing modifications, the temperature sensor 80 is positioned at the supply-side connection passage 70, 170, 270, 370, 470, 570, 670. However, another temperature sensor 80 may also be provided at the discharge-side connection passage 71.

In the liquid ejecting device 710 of the seventh modification, another temperature sensor 80 is also provided at the forming member 72D defining the discharge-side connection passage 71, in addition to the temperature sensor 80 disposed at the forming member 72S defining the supply-side connection passage 70.

With this structure, the controller 15 may control operations of the heater 85 based on the temperatures detected by the temperature sensors 80 provided at the supply-side connection passage 70 and at the discharge-side connection passage 71, respectively. With this configuration, since the temperature of the liquid flowing through the manifolds 38 can be controlled more precisely, viscosity of the liquid can be appropriately estimated based on the detected temperatures. Hence, this configuration can provide a suitable control on the flow velocity of the liquid in the manifolds 38.

<Modification 8>

In the above-described embodiment and the foregoing modifications, the heater 85 is positioned at the tank 83. However, the heater 85 may be positioned at a passage upstream of the temperature sensor 80, such as in the supply passage 81 or in the supply-side connection passage 70, 170, 270, 370, 470, 570, 670, for example. Alternatively, the heater 85 may be disposed in a passage downstream of the temperature sensor 80, for example, in the discharge-side connection passage 71 or in the discharge passage 82.

<Modification 9>

According to the above-described embodiment and the foregoing modifications, two manifolds 38, 138, 238, 338, 438, 638 are provided each connected to each of the supply-side connection passages 70, 170, 270, 370, 470, 570, 670 and the discharge-side connection passage 71. However, three or more manifolds may be provided to be connected to each of the supply-side connection passages 70, 170, 270, 370, 470, 570, 670 and the discharge-side connection passage 71.

Note that the depicted embodiment and the foregoing modifications may be appropriately combined with one another, as long as no contradiction is involved.

It would be apparent to those skilled in the art that the embodiment and foregoing modifications described above are merely an illustrative example of the present disclosure and that various modifications may be made therein without departing from the scope of the disclosure.

[Remarks]

The liquid ejecting devices 10, 110, 310, 410, 510, 610, 710 are an example of a liquid ejecting device. The nozzles 21 are an example of a plurality of nozzles. The pressure chambers 31 are an example of a plurality of pressure chambers. The piezoelectric elements 42 are an example of a plurality of piezoelectric elements. The manifolds 38, 138, 238, 338, 438, 638 are an example of a plurality of manifolds. The supply passage 81 is an example of a supply passage 81. The supply-side connection passages 70, 170, 270, 370, 470, 570, 670 are an example of a connection passage. The temperature sensor 80 is an example of a temperature sensor. The supply opening 81*a* is an example of a supply opening. The inlet opening 39*a* is an example of an inlet opening. The top surfaces 39*c*, 139*c*, 239*c*, 339*c*, 439*c*, 639*c* are an example of a top surface. The bottom surface 39*e*, 139*e*, 239*e*, 339*e*, 439*e*, 639*e* is an example of a bottom surface. The COF 60 is an example of a circuit board. The driver IC 61 is an example of a driver circuit. The forming member 72S is an example of a forming member. The bottom surfaces 74, 374 are an example of a bottom surface of the connection passage. The lower portions 76*a*, 376*a*, 476*a*, 676*a* are an example of an end face. The discharge passage 82 is an example of a discharge passage. The discharge-side connection passage 71 is an example of a discharge-side connection passage. The heater 85 is an example of a heater. The array direction is an example of a first direction. The laminating direction is an example of a second direction.

What is claimed is:

1. A liquid ejecting device comprising:

a plurality of nozzles;

a plurality of pressure chambers each in communication with each of the plurality of nozzles;

a plurality of piezoelectric elements each configured to apply pressure to liquid stored in each of the plurality of pressure chambers;

a plurality of manifolds in communication with the plurality of pressure chambers;

a supply passage configured to supply the liquid to the plurality of manifolds;

a single connection passage connecting the supply passage to each of the plurality of manifolds, and configured to distribute the liquid supplied from the supply passage into the plurality of manifolds; and a single temperature sensor provided at the connection passage and configured to detect a temperature of the liquid flowing through the connection passage.

2. The liquid ejecting device according to claim 1, wherein the plurality of nozzles are arrayed with one another in a first direction; and wherein the supply passage has a supply opening, the supply passage being in communication with the connection passage through the supply opening, the temperature sensor being provided at a position coincident with a position of the supply opening in the first direction.

3. The liquid ejecting device according to claim 1, wherein the plurality of nozzles are arrayed with one another other in a first direction; and wherein the connection passage is positioned outside of a region in which the plurality of pressure chambers are formed in the first direction.

4. The liquid ejecting device according to claim 1, wherein the plurality of nozzles are arrayed with one another other in a first direction;

wherein each of the plurality of manifolds has a top surface and a bottom surface in a second direction orthogonal to the first direction, the temperature sensor being positioned in a region between the top surface and the bottom surface in the second direction.

5. The liquid ejecting device according to claim 1, further comprising a circuit board equipped with a driver circuit configured to output signals for driving the piezoelectric elements, wherein the temperature sensor is connected to the circuit board through a lead wire.

6. The liquid ejecting device according to claim 1, wherein the connection passage is defined by a forming member, the temperature sensor being positioned at an outer surface of the forming member.

7. The liquid ejecting device according to claim 1, wherein the supply passage has a supply opening, the supply passage being in communication with the connection passage through the supply opening;

wherein each of the plurality of manifolds has an inlet opening, each manifold being in communication with the connection passage through the inlet opening; and wherein the connection passage has a bottom surface sloping in a direction from the supply opening toward the inlet opening.

8. The liquid ejecting device according to claim 1, wherein the supply passage has a supply opening, the supply passage being in communication with the connection passage through the supply opening;

wherein each of the plurality of manifolds has an inlet opening and a top surfaces, each manifold being in communication with the connection passage through the inlet opening; and wherein the connection passage has an end surface connected to each of the top surfaces, the end surface sloping in a direction from the supply opening toward each inlet opening.

9. The liquid ejecting device according to claim 1, wherein each of the plurality of manifolds has a top surface; and wherein the connection passage is continuously connected to each of the top surfaces without any stepped portion.

10. The liquid ejecting device according to claim 1, further comprising:

a discharge passage into which the liquid is configured to be discharged from the plurality of manifolds; and a discharge-side connection passage connected to the discharge passage and each of the plurality of manifolds, and configured to discharge the liquid from the plurality of manifolds to the discharge passage; and another temperature sensor provided at the discharge-side connection passage and configured to detect a temperature of the liquid flowing through the discharge-side connection passage.

11. The liquid ejecting device according to claim 1, further comprising another temperature sensor provided at the connection passage, wherein the plurality of nozzles are arrayed with one another in a first direction; and wherein each of the temperature sensor and the another temperature sensor is aligned with each of the plurality of manifolds in the first direction.

12. The liquid ejecting device according to claim 1, further comprising a heater for heating the liquid, the heater being positioned upstream of the temperature sensor in a direction in which the liquid flows from the supply passage to the plurality of manifolds through the connection passage.

13. The liquid ejecting device according to claim 1, further comprising:

a discharge passage into which the liquid is configured to be discharged from the plurality of manifolds; and a discharge-side connection passage connected to the discharge passage and each of the plurality of manifolds, and configured to discharge the liquid from the plurality of manifolds to the discharge passage, the liquid discharged out of the discharge passage being allowed to flow into the supply passage; and a heater for heating the liquid, the heater being positioned downstream of the plurality of manifolds but upstream of the temperature sensor in a direction of circulation of the liquid.

14. The liquid ejecting device according to claim 1, wherein the plurality of nozzles are arrayed with one another in a first direction; and wherein the temperature sensor is positioned opposite the plurality of manifolds with respect to the supply passage in the first direction.

* * * * *